United States Patent [19]

Morris

[11] 4,004,393

[45] Jan. 25, 1977

[54] ADJUSTABLE HEIGHTH SHORING

[75] Inventor: Ronald G. Morris, Beaver Falls, Pa.

[73] Assignee: Beaver-Advance Corporation, Ellwood City, Pa.

[22] Filed: Nov. 28, 1975

[21] Appl. No.: 636,208

[52] U.S. Cl. ..... 52/637; 52/655; 182/178; 403/49

[51] Int. Cl.[2] ..... E04H 12/00; E04G 7/00

[58] Field of Search ..... 52/637, 638, 655; 182/178, 179; 403/49, 108, 59

[56] References Cited

UNITED STATES PATENTS

| | | | |
|---|---|---|---|
| 1,279,299 | 9/1918 | Du Brau | 182/179 |
| 1,593,945 | 7/1926 | Macklem | 182/178 |
| 2,665,950 | 1/1954 | Johnson | 52/637 |
| 2,698,552 | 1/1955 | Smith | 403/49 |
| 2,701,167 | 2/1955 | Kirkpatrick | 403/49 |
| 2,811,395 | 10/1957 | Jagiel | 52/637 |
| 3,190,405 | 6/1965 | Squire | 52/637 |
| 3,604,175 | 9/1970 | Gray | 52/637 |

FOREIGN PATENTS OR APPLICATIONS

| | | | |
|---|---|---|---|
| 1,196,129 | 5/1959 | France | 52/638 |

*Primary Examiner*—James L. Ridgill, Jr.
*Attorney, Agent, or Firm*—Parmelee, Miller, Welsh & Kratz

[57] ABSTRACT

A shoring or scaffold for construction, maintenance and other work, using stacked scaffold sections of a demountable type and having a heighth adjusting construction is provided. Each section has a pair of spaced-apart end frames that are demountably cross-connected with respect to each other and the end frames of upper and lower sections have a telescopic adjustable relation to meet heighth requirements. To provide strength and support rigidity, dual-tire bracing members are utilized to extend from the end frame of a lower section across and in an interconnecting relation with an opposed end frame of an upper section. A simple adjustment of the bracing members in conformance with vertical adjustments made between upper and lower sections is accomplished by utilizing members that at one end have a gooser pivot mounting on a horizontally extending connecting member of a frame of one section and that at the other end have a latching arm which is provided with a group of spaced-apart latching hole portions whose spacing is proportioned to vertical adjustment positions between the upper and lower sections. The latching hole portions are adapted to selectively detachably latch with a single latching pin means which is carried in a protected relation on an inwardly offset, short length or secondary leg member of the opposed frame of the other section. This enables the use of a single brace member for different heighth adjustments of stacked sections.

11 Claims, 14 Drawing Figures

ADJUSTABLE HEIGHTH SHORING

BACKGROUND OF THE INVENTION

1. Field of the Invention

This invention pertains particularly to an improved cross bracing construction for securely, detachably and adjustably connecting heighth adjustable sections of shoring or scaffolding. Another phase of the invention relates to the provision of a bracing member that enables a pivoted and sliding movement at one end thereof for, among other things, facilitating detachable engagement and disengagement of spaced-apart latching hole portions at its other end with respect to latching pin means.

2. Description of the Prior Art

Various types of cross brace member utilizations have been provided in the art for the purpose of making possible an adjustable change of the connected relationship of such members in accordance with vertical adjustments that are made between frames of upper and lower scaffold sections. Although it is possible to use a plurality of brace members of different lengths to compensate for the various adjustments, this is not too practical from the standpoint of minimizing the number of members for shipment and storage as well as installation purposes and particularly, for facilitating assembly or erection of scaffolding at a building site.

For the above purpose, one form of construction utilizes a series of spaced-apart, outwardly exposed, so-called attachment pins along the supporting leg members of one of the sections that have a spacing that corresponds to selected vertical adjustments between the sections. Another construction employs a series of vertically spaced-apart cross-extending so-called headers on the frames of a section to which ends of cross bracing members may be alternately attached to compensate for vertical adjustment of the sections with respect to each other. The type involving the use of outwardly exposed attachment pins along the legs has the disadvantage that the pins tend to become bent and damaged, particularly during the shipping and storage, and also due to the fact that they tend to serve as hazards for clothing of workers when the apparatus is being dismantled. On the other hand, the type involving the use of headers increases the cost, adds weight to the sections and complicates the use of the cross braces. Although I have developed an assembly using protected latching pins and brace members having latching slots at opposite ends thereof, there is a need for an improved assembly which will enable one end of the bracing members to be swingably and horizontally slidably mounted and positively retained in a foldable relation when the scaffold is to be dismantled and compacted for storage or shipment.

There has thus been a need for an inexpensive, simplified and improved form of cross bracing construction which will make possible the use of so-called standard length or a single set or group of cross braces which will, in their utilization, facilitate selective adjustments in conformance with vertical adjustments between the upper and lower sections, which will enable the use of protected latching pins for one end of the braces and the use of positively but detachably retaind, endwise-slidable, swingable, bracket mounting of their other ends.

SUMMARY OF THE INVENTION

It has thus been an object of the invention to solve the problem presented by prior types of adjustable cross bracing constructions for upper and lower sections of a scaffold, and to enable the provision of a brace member utilization that will meet the above-mentioned need.

Another object of the invention has been to devise an adjustable shoring which provides an improved rigidity as assembled and which will enable brace members to be either retained in a swung-back folded relation along one section or to be fully removed from all sections when the shoring is being disassembled for storage or shipment.

Another object of the invention has been to provide an improved utilization and construction of cross brace members that are of standard length but of adjustable connection between upper and lower shoring sections.

Another object of the invention has been to provide an attachment arrangement which will enable the use of protected latching pins and latching holes for one end of cross brace members and which will employ endwise slidably adjustable, detachably but positively retained, swingable bracket means for the other end of the brace members.

A further object of the invention has been to devise a mounting and construction of bracing members which will enable the members to be pivotally swung and endwise-slid in a positively connected relation to one end thereof along a connecting member for selectively detachably connecting each of them at different positions along their other end portions with respect to and on an associated latch pin.

These and other objects of the invention will appear to those skilled in the art from the illustrated embodiment and the claims.

DESCRIPTION OF THE DRAWINGS

FIG. 9A shows a spring-pressed latching element in a closed position for retaining the swing bracket on a connecting or cross bar member and FIG. 9B shows the latching element moved inwardly to an unlatching position.

DESCRIPTION OF THE PREFERRED EMBODIMENT

Figures 1, 2, 3, 3A:
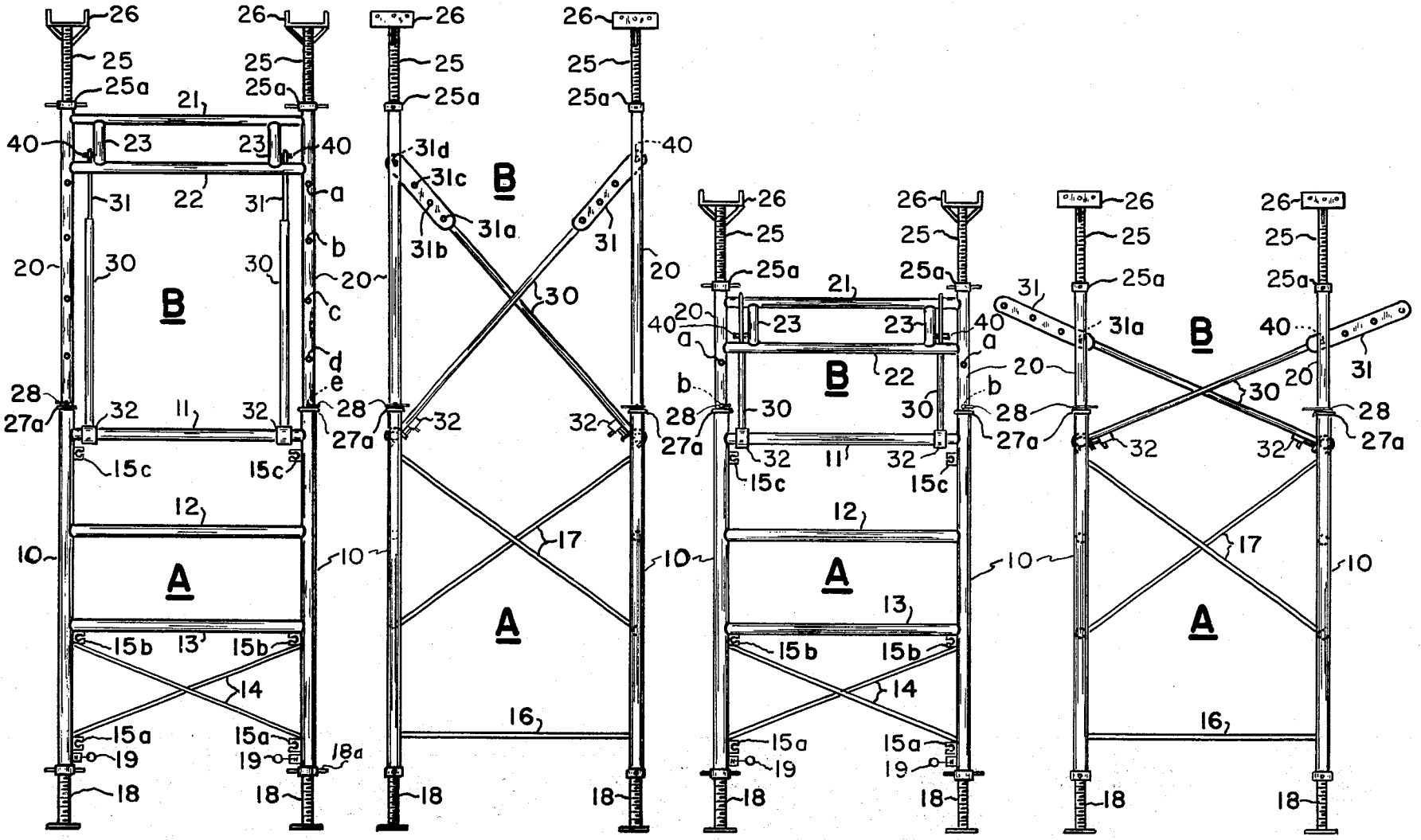
FIG. 1 is a vertical view in elevation of a shoring or scaffold employing the invention and having lower and upper sections in a mounted position with respect to each other; in this figure, the upper section has a maximum upwardly adjusted positioning with respect to the lower section.
FIG. 2 is a vertical view in elevation on the same scale as FIG. 1, but showing the construction taken at right angles to FIG. 1, and with the sections in the same mounted relationship as in FIG. 1.
FIG. 3 is a vertical side view on the scale of FIG. 1 and on the same side of the assembly as this figure, illustrating a lowered positioning of the upper section and a corresponding adjustment of cross bracing utilized in connection therewith.
FIG. 3A is a view on the same scale as and from the same side as FIG. 2; this view shows the sections in the same adjusted positioning as in FIG. 3.

With particular reference to FIGS. 1 to 3 of the drawings, a representative scaffolding assembly embodying the invention is illustrated which has a lower or base supporting section A and an upper stacked or elevated section B. Both sections are provided with a pair of opposed frames that are connected together by removable or detachable cross brace members in such a manner as to enable the frames to be stacked or folded in a substantially flat relation when the scaffold is to be stored or conveyed. The pair of opposed upright end frames of the lower scaffold A are of the same construction. Also, the pair of opposed upright end frames of section B are of the same construction with respect to each other, but of different construction than the frames of the lower section A.

Each end of the lower scaffold section A has a pair of primary, main, outer, vertical leg members 10 of hollow tubular construction that are cross-connected by horizontally extending, tubular bars or connecting members 11, 12 and 13 in a vertically spaced-apart relation with respect to each other. The member 11 to 13, as well as criss-cross connected rod members 14 that extend between the legs 10 of each frame are secured, as by weld metal, in a permanent fashion at their ends between such leg members. Cam-receiving lock brackets 15a, 15b and 15c are also shown extending inwardly from inner sides of the main leg members 10 to detachably receive male cam lock end portions of a detachable, rod-like, horizontal brace member 16 and of criss-crossing, detachable, rod-like brace members 17 (see FIG. 2) for securing the opposed frames of the lower section A in a spaced-apart opposed relation as illustrated in this figure. Suitable cam lock means is illustrated in Weisz U.S. Pat. Nos. 2,483,862 and 2,808,297, as well as in Morris U.S. Pat. No. 3,888,595. However, any suitable detachable means may be used for the brace member 16 and the cross brace members 17 to connect the upright end frames of the lower section A together.

The upper section B has a pair of opposed frames, each provided with a pair of spaced-apart vertical or upright, primary, main or outer, tubular leg members 20 which are adapted to telescope or slidably fit within upper ends of the leg members 10 of the section A, and which are adapted to be moved between adjusted positions with respect to associated aligned lower frames of the lower section A through the agency of cross-extending, adjustment holes *a* to *e*, inclusive, see particularly FIGS. 1 and 3. Each end frame of the upper section B has its pair of horizontally spaced-apart primary or outer upright leg members 20 secured together adjacent their upper end portions by a pair of vertically spaced-apart, cross-extending, horizontal connecting bar members 21 and 22 which, like the members 11, 12 and 13, are also preferably of tubular construction.

A pair of shorter length, secondary and inwardly positioned, tubular vertical leg members 23 are secured at their ends between the cross-connecting members 21 and 22 to reinforce the connection between the main leg members 20 and to enable the use of an inwardly protected, sidewise-outwardly projecting, single connector latch pin 40 for each upper, adjustable arm 31 of a dual tier, cross brace member 30. Each latch pin 40, as shown in FIGS. 1 and 3, extends within a protected side area that is within a plane defined by and spacing between primary and secondary leg members 20 and 23 as well as connecting members 21 and 22. As shown in the drawings, the dual tier cross brace members 30 may be generally tubular or rod-like construction and are adapted to extend from and between opposite end frames of the lower and upper sections A and B to rigidly secure them in an assembled relation with respect to each other.

Figure 9:
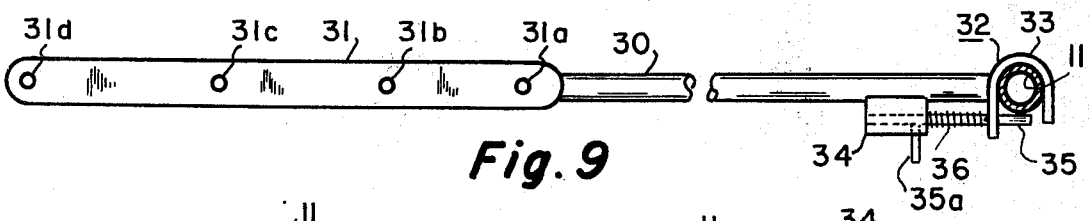
FIG. 9 is an enlarged side view of a cross brace member of the invention showing its slidable, swingable, latching end-positioned bracket and its adjustable arm.
Figure 9A:
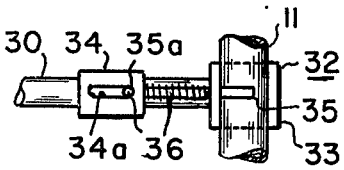
FIGS. 9A and 9B are underside plan, detail views on the scale of FIG. 9 and particularly illustrating the construction and operation of the swing bracket of FIG. 9.
Figure 9B:
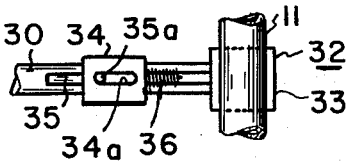
Figure 9C:
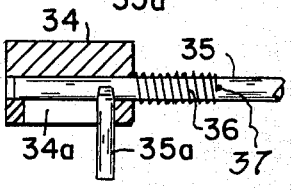
FIG. 9C is a further enlarged detail of and taken as a section through the mechanism of FIGS. 9A and 9B, showing the latching element in the same position as in FIG. 9A.

As illustrated in FIG. 9, each section to section or dual tier cross brace member 30 is shown provided at its lower end with a gooser or swing bracket type of latch part 32 that has a U-shaped bracket 33 that is adapted to fit over an associated, upper, cross-connecting member 11 of each end frame of the lower section A in a pivotally swingable and endwise or sidewise-slidable relation with respect thereto. As particularly illustrated in FIGS. 9A to 9C, an operating housing 34 is secured on the brace member 3 to endwise-slidably carry and position therein a locking pin 35. The pin 35 has an outwardly projecting, pin-like, operating finger or handle **35*a* extending therefrom and movable within the longitudinal extent of an elongated slot 34*a* along the housing 34. The locking pin 35, itself, extends through an endwise-open, cylindrical hole portion in the housing 34 and is urged under tension to an outer or locking position, such as shown in FIGS. 9, 9A and 9C, by a spiral or helical spring element 36. It will be noted that one end of the spring element 36 abuts a cross-extending stop lug or pin 37, while the other end abuts against a front end of the housing 34 to, as shown in FIG. 9, cause the pin 35 to advance to substantially close-off the spacing between the opposite sides of the bracket 30 and positively swingably retain the bracket on the associated connecting member 11**.

The opposite and, as shown, the upper end of each section to section, cross brace member 30 has a group of spaced-apart, through-extending latching hole or slot portions 31*a* to 31*d* in differently spaced positions along its flattened or substantially planar latching arm part 31 to provide selective latching positions for the arm part with respect to an associated latch pin 40. Compare the uppermost positioning of FIGS. 1 and 6 with the third from lowermost positioning of FIGS. 3 and 3A. It will be noted that the number of hole portions in the arm 31 of each brace member 30 is shown about one less than the number along each primary leg member 20, since it has been found that the brace members 30 are unnecessary when the upper section B is telescoped downwardly within the leg members 10 of the lower section A sufficient to make use of the last hole portion *a*.

Figure 7:
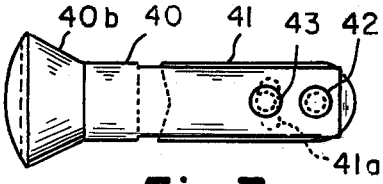
FIG. 7 is an enlarged side view of a latching pin that may be used for receiving and retaining the adjustable arm end portion of a cross brace member in a connected relation with an inner or secondary leg member of an upper scaffold section; in this view a keeper element is shown in an aligned position within the pin which is attained when a brace member is to be moved into a position on or to be moved off the pin.
Figure 8:
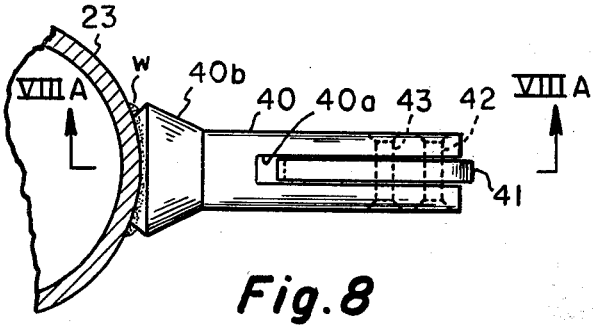
FIG. 8 is a top plan view of the pin of FIG. 7 showing it secured on and projecting from an associated inner vertical leg member.
Figure 8A:
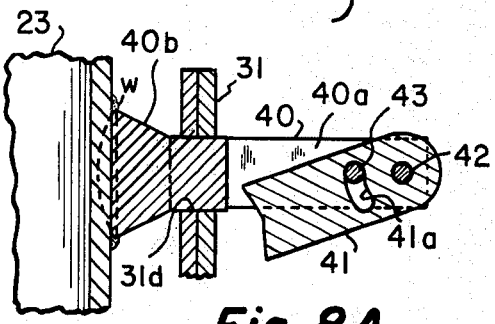
FIG. 8A is a section taken along the line VIIIA—VIIIA of FIG. 8 and showing the keeper element in a gravity-engendered "down" or latching position.

With particular reference to FIGS. 7, 8 and 8A, each latch pin 40 is shown secured to its associated secondary leg member 23 by weld metal *w* at its innermost, enlarged mounting end portion 40*b*. The stem of uniform rounded shape is shown as a substantially solid rod-like portion of the latch pin 40; it has an endwise-open slot or bifurcation 40*a* therein to receive a latch keeper element or finger 41. As shown particularly in FIG. 8A, the latch keeper element 41 is, at its outer end, swingably mounted within the bifurcation provided by the slot portion 40*a* by a cross rivet pin 42. A secondary, inwardly spaced pin 43 is also carried crosswise of the bifurcated slot portion 40*a* and is adapted to provide a movement-limiting guide for the keeper 41, as defined by the end-limits of a curvilinear, relatively short-length, vertical slot portion 41*a* extending laterally of the keeper. The innermost end portion of the keeper 41 is adapted to swing between a position wholly in alignment along and within the body of the latch pin 40 to a downwardly sloped position, shown in FIG. 8A, at which it serves as a locking keeper for the arm 31 of an associated latched-on brace member 30. When the brace member 30 is to be moved on or off the pin 40, the keeper 41 is manually held in an aligned position; it is permitted to drop by gravity to the locking position of FIG. 8A which it retains until it is again moved manually or by a change of gravity positioning into alignment.

The construction and mounting of the bracket 33 enables the cross brace 30 to be endwise-slid on its associated connector member 11 to facilitate full "on" and "off" movement of one of the latching hole portions 31*a*, etc., with respect to its associated latch pin 40. It also enables the workman to slide the two brace members 30 on their common associated member 11 to a more suitable location for packing the equipment for storage or shipment, without removing them from the member 11. However, where it is desirable to remove one or more of the braces 30, this can be easily accomplished by moving the pin 35 against tension exerted by the spring 36 to a retracted position with respect to the open side of the bracket 33.

Figure 6:
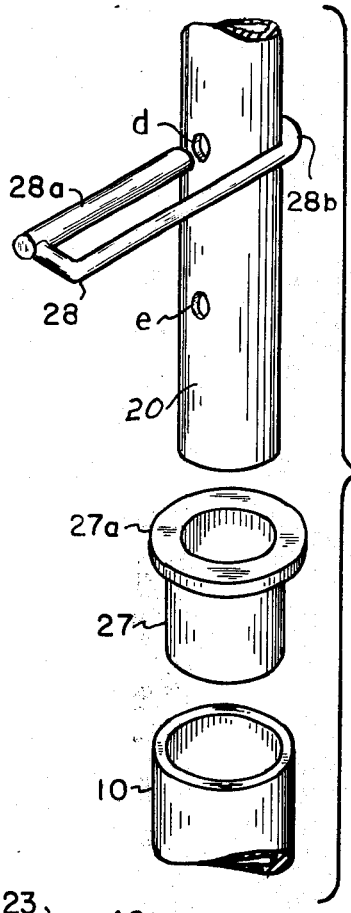
FIG. 6 is an enlarged, exploded vertical perspective view in elevation of clip-like latching pin and collar assembly that may be used in interconnecting and securing main or outer leg members of the upper and lower sections in a reinforced, secure, adjusted telescopic relation with respect to each other.

FIG. 6 shows a representative type of position-retention, connector pin assembly for retaining the leg members 20 of the frames of the upper section B in a desired adjusted positioning with respect to the associated leg members 10 of the lower section A. To reinforce the assembly of a cooperating pair of upper and lower leg members 20 and 10, a hollow connector or slip collar 27 is shown provided with an upper end rim or flange portion 27*a*. The collar 27 has an outer diameter slightly smaller than the inner diameter of the leg member 10 to slidably fit therein until its upper flange portion 27*a* rests upon the upper edge of the leg member. The inner diameter of the connector 27 is such as to slidably receive the associated upper leg member 20 and permit its adjustment to align one of the through-extending latching hole portions, such as *d*, with and immediately above the flange 27*a*. This permits the use of a position-retention, connector or clip pin element 28 for retaining a pair of aligned upper and lower leg members 20 and 10 in a suitable vertically adjusted position.

As shown in FIG. 6, the connector pin or clip 28 which serves as a position retention element, has a thickened pin or rod-like latch portion 28*a* that is adapted to be slid through one of the slotted portions, such as *d*. The connector pin 28 also has a looped arm or clip retention leg portion 28*b* which, at its extending end, is bent to conform to the curvature of the leg 20, and which at its connected end, is spaced from the latch portion 28*a* a distance that substantially corresponds to the distance between the hole *d* and the opposed outer periphery of the leg member 20. This construction enables the connector pin 28 to be retained on a leg member 20 when it is not in latching use (requiring endwise-slide-off) and, at the same time enables it to be easily inserted and removed from an aligned position within one of the hole portions *a* to *e*, inclusive, of a leg member 20.

Figure 4:
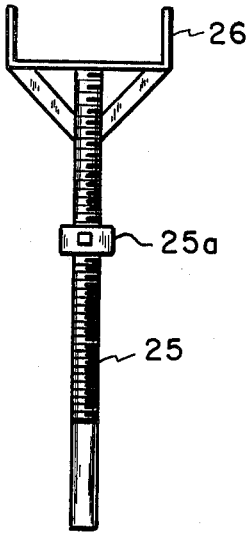
FIG. 4 is an enlarged side view in elevation of an adjustable shoring head assembly which may provide a saddle for receiving overhead stringers of a building construction.
Figure 5:
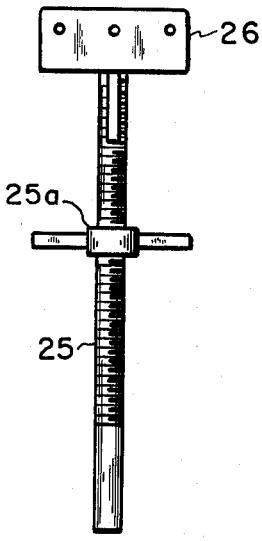
FIG. 5 is a side elevation of the head assembly on the same scale as and taken in a right angular relation with respect to FIG. 4.

By way of example, an adjustable, screw-like foot or jack assembly 18 is provided for each leg 10 of the lower section A. Its threaded or screw stem is adapted to extend within the hollow end of the associated leg member 10, and its threaded hand-grip, adjustment nut 18*a* (see FIG. 1) is adapted to abut the lower end of the leg member along the threaded stem portion. A somewhat similar type of assembly 25 is provided for an adjustable shoring head 25. As shown in FIGS. 4 and 5, the head assembly 25 also has a threaded stem which is adapted to extend within the upper end of an associated leg member 20 to extend upwardly therefrom. It also has a hand-operable adjustment nut 25*a*, and upwardly extending channel-shaped, stringer-receiving, U-shaped or saddle portion 26. The assemblies 18 and 25 thus provide smaller height adjustments for the scaffold and enable the scaffold to be used on uneven terrain and to engage overhead stringers that may, for example, be of slightly different height.

I claim:

1. In an adjustable heighth scaffold having substantially rectangular upper and lower sections, each section having a pair of horizontally spaced-apart upright end frames, each end frame having a pair of tubular transversely spaced-apart upright primary supporting leg members, and the lower ends of the leg members of the upper section being adapted to telescopically adjustably fit with the upper ends of the leg members of the lower section, the improvement which comprises: a horizontal connector member integrally secured to and extending across between the pair of supporting leg members of each end frame of one of said sections adjacent an upper end portion thereof, a pair of horizontal cross-extending members integrally secured to and positioned in a vertically spaced-apart relation with respect to each other between the pair of supporting leg members of each end frame of the other of said sections adjacent an upper end portion thereof, a pair of shorter length leg members extending vertically across and being integrally secured between each said pair of cross-connecting members, each said pair of shorter length leg members being positioned in an adjacent inwardly spaced relation with respect to an associated supporting leg member of its frame, latch pin means secured on each of said shorter length leg members, a pair of cross brace members for detachably connecting each end frame of the one section with an opposite end frame of the other section, each of said cross brace members being provided with a swing bracket latching means at one end thereof and a latching arm at the other end thereof having a group of lengthwise spaced-apart latching hole portions, said swing bracket latching means being adapted to pivotally engage on said connector member of one end frame of said one section, and said latching arm being adapted to have one of its latching hole portions latch-engage said latch pin means of the opposite end frame of said other section.

2. In a scaffold as defined in claim 1, each swing bracket latching means for detachably retaining it on the associated said connector member.

3. In a scaffold as defined in claim 1, said pair of shorter length leg members being of tubular construction, and said latch pin means extending from an associated one of said shorter length leg member into the space between it and an adjacent said supporting leg member.

4. In a scaffold as defined in claim 1, each of said brace members being of tubular construction, said latching arm being flattened along its group of latching hole portions, and means carried by each said latch pin means and cooperating with said latching arm for retaining one of said latching hole portions in a latching position on said latch pin means during usage of the scaffold.

5. In a scaffold as defined in claim 1, said swing bracket latching means comprising: a U-shaped bracket adapted to fit over the associated said connector member, and locking pin and spring means for movement into and out of a closing-off relation with respect to said U-shaped bracket to retain said bracket on the associated said connector member during usage of the scaffold.

6. In a scaffold as defined in claim 1, a connector plug adapted to fit over the lower end portion of each of said supporting legs of the upper section and within the upper end portion of an associated endwise-aligned supporting leg of the lower section, a cross pin adapted to extend through each said supporting leg of the upper section to rest on said connector plug for retaining each said supporting leg of the upper section in position within said plug and with respect to the associated said supporting leg of the lower section, a circumferential flange extending outwardly from an upper end of said connector plug to rest on the upper edge of an associated said supporting leg of the lower section, and said cross pin being adapted to rest on said flange.

7. In a scaffold as defined in claim 6, a group of vertically spaced through-extending holes along a lower end portion of each said supporting leg of the upper section, a connector pin having a looped arm bent to conform to the curvature of the associated said supporting leg of the upper section and which at its outer end is connected to said cross pin to cooperate therewith for retaining said connector pin on the associated said supporting leg of the upper section, and said cross pin being movable into and out of said holes for adjusting the vertical positioning of an associated said supporting leg of said upper section with respect to an associated said supporting leg of the lower section.

8. In a scaffold as defined in claim 1, each of said cross brace members being of substantially tubular construction and being flattened along its said latching arm, said swing bracket latching means of each of said cross brace members having a U-shaped bracket to fit over the associated said connecting member and having a latch pin for detachably retaining said U-shaped bracket on the associated said connecting member, a housing secured on each of said cross brace members and having an elongated slot to endwise-slidably receive an end of said pin latch therein, a spring carried on an opposite outer end of said latch pin means to abut said housing and urge said pin means into a cooperating outward member-retaining position with said U-shaped bracket, and each said latch pin having a finger secured thereon and operatively positioned to extend outwardly therefrom in a guided relation within said slot for manually moving said latch pin to an inner member-releasing position within said housing to enable a removal of the associated said connecting member from a retained position within said U-shaped bracket.

9. In a scaffold as defined in claim 8, said horizontal connector members being carried between said supporting leg members of the frames of the lower section, and said pair of horizontal cross-connecting members and said pair of short length leg members being carried on the end frames of the upper section.

10. In a scaffold as defined in claim 9, each end frame of the lower section having at least one additional cross-connecting member on each of its end frames in a downwardly spaced relation with respect to said horizontal connector member, and a pair of criss-crossed connecting members secured between said supporting legs of each end frame of the lower section adjacent a lower end portion thereof.

11. In a scaffold as defined in claim 9, a shoring head adjustably carried on and fitting within the upper ends of said supporting legs of the frames of the upper section for positioning stringers thereon, and each of said shoring heads having an upwardly open channel-shaped portion to define a saddle for receiving the stringers.

* * * * *

UNITED STATES PATENT OFFICE

CERTIFICATE OF CORRECTION

PATENT NO. : 4,004,393

DATED : January 25, 1977

INVENTOR(S) : Ronald G. Morris

It is certified that error appears in the above-identified patent and that said Letters Patent are hereby corrected as shown below:

Column 1, line 67, cancel "retaind" and substitute --retained--.

Column 3, line 55, cancel "member" and substitute --members--.

Signed and Sealed this

Nineteenth Day of April 1977

[SEAL]

*Attest:*

RUTH C. MASON
*Attesting Officer*

C. MARSHALL DANN
*Commissioner of Patents and Trademarks*